United States Patent [19]

Meyer et al.

[11] Patent Number: 4,704,134

[45] Date of Patent: Nov. 3, 1987

[54] COAL DERIVED/AQUEOUS FUEL SYSTEM AND METHOD OF MANUFACTURE

[75] Inventors: Edmond G. Meyer, Laramie, Wyo.; Lee G. Meyer, Englewood, Colo.

[73] Assignee: Carbon Fuels Corporation, Englewood, Colo.

[21] Appl. No.: 651,950

[22] Filed: Sep. 19, 1984

Related U.S. Application Data

[63] Continuation-in-part of Ser. No. 427,937, Sep. 29, 1982, Pat. No. 4,475,924, which is a continuation-in-part of Ser. No. 247,382, Mar. 24, 1981, abandoned.

[51] Int. Cl.[4] ..... C10L 1/32

[52] U.S. Cl. ..... 44/51; 44/1 SR; 44/1 R; 406/47

[58] Field of Search ..... 44/51, 1 SR

[56] References Cited

U.S. PATENT DOCUMENTS

| | | | |
|---|---|---|---|
| 4,192,651 | 3/1980 | Keller | 44/15 R |
| 4,208,251 | 6/1980 | Rasmussen | 44/51 |
| 4,351,645 | 9/1982 | Marion et al. | 48/61 |
| 4,490,156 | 12/1984 | Marion et al. | 48/61 |

*Primary Examiner*—Jacqueline V. Howard
*Attorney, Agent, or Firm*—Lee G. Meyer

[57] ABSTRACT

Coal char produced by the pyrolytic destructive thermal distillation of coal in the absence of oxygen is ground, sized and then admixed in suitable portions with water to form a fluidic, liquid-solid fuel system comprising a nonpolluting, stable, transportable, high energy fuel. The fuel system can be fired directly or the char can be separated and fired as a solid fuel. The liquid organic fraction obtained from the low boiling fractions derived from the pyrolysis of coal is used as a fuel or as a feed stock.

26 Claims, No Drawings

COAL DERIVED/AQUEOUS FUEL SYSTEM AND METHOD OF MANUFACTURE

TECHNICAL FIELD

This application is a continuation-in-part of U.S. patent application Ser. No. 427,937 filed Sept. 29, 1982, now U.S. Pat. No. 4,475,924 issued Oct. 9, 1984, which is a continuation-in-part of U.S. patent application Ser. No. 247,382 filed Mar. 24, 1981, now abandoned. The parent application which is incorporated in its entirety by reference as if it were completely set out herein, discloses a transportable fuel system as well as completely combustible, transportable fuel compositions derived from coal, which compositions contain particulate coal char, and methods for making such a system. The parent application specifically discloses that the fuel system can be derived entirely by the pyrolysis of coal.

The instant invention relates to fluidic transportable fuel systems and fuel compositions, which fuel systems contain particulate coal char derived from solid carbonaceous fuels such as coal, lignite and lower rank coals, and the like slurried in water. More particularly, this invention relates to high energy, non-polluting, transportable fluidic fuel systems and methods for making such systems. In one aspect, the fluidic fuel is fired directly into a liquid-fueled combustion device. In another aspect, the transportable fuel composition forms a fuel transport medium which is dewatered and the particulate coal char is used as a fuel for solid-fuel fired combustion devices. The liquid organic material which is produced simultaneously with the char is used as a liquid fuel for liquid-fuel fired combustion devices or as a feedstock in refinery or chemical application.

BACKGROUND ART

In the United States, there is fifteen times as much recoverable coal as recoverable oil and natural gas combined. Coal, therefore, should be the primary fuel for large stationary and mobile combustion installations and for production of process heat. Not only should America's energy needs increasingly be met by coal, but coal could also meet the needs of other industrialized and developing countries. Coal could be America's answer to the "energy" balance of trade deficit. However, such is not presently the case.

Although 200 billion tons of economically recoverable coal, and an undetermined amount of coal which is not presently economically recoverable, are present in the United States (representing more than 70% of domestic fossil energy resources), coal currently supplies less than 20% of all of our energy production. A number of factors have combined to create this disparity. Even with the abundance of coal energy, it has not heretofore been competitive with, nor as easily utilized as, other fossil fuels such as oil, natural gas and the like.

One very effective use of our coal resources is in stationary plants producing electricity or process heat. Stationary power conversion facilities do not require high performance liquid and gaseous hydrocarbons. These fuels are better utilized in transportation and certain residential/commercial uses. However, the use of coal in stationary power facilities requires that either the solid be transported to the power facility or the power plant be constructed at the mine site for "mine mouth" utilization of the coal. Utilization at the mine site is not always an efficient method for producing electricity because of environmental problems, and electrical transmission losses. Yet, production of electrical energy at other than the mine site requires that the solid coal be transported to the power plant. Coal is currently shipped by rail in unit trains but the current rail capacity may be inadequate to move the tonnage required to replace existing use of more costly and scarce liquid and gaeous fuels. Moreover, the required handling of coal as a solid fuel is cumbersome, wasteful and expensive.

The greatest deterrent to full utilization, domestic and foreign, of the United States' coal resource is the nature of coal itself. First, raw coal is not a uniform combustion product. Second, as a solid it is difficult to handle and expensive to transport. Third, it contains organic sulfur and nitrogen, which, upon combustion, produce air pollutants which have been associated with acid rain. Fourth, it contains ash which, upon combustion produces pollutants and slag. In addition to the above problems, the majority of the energy transportation and combustion systems in this country revolve around oil and natural gas which are relatively uniform, pipeline tranportable liquid and gaseous fuels. The coal transportation and quality problems are compounded by the fact that, although coal reserves are distributed throughout the U.S., coal from different reserves has a wide range of characteristics. Coals, even of the same rank, have different compositions. This limits the interchangeability of coal in combustion systems and thus increases expense and reudces markets. For example, intermountain Western coal, while low in sulfur, is also generally low in BTU per unit weight and has a high water content. Each type of coal requires different pollution control equipment and a specific boiler system. Coal of one region (or even of a particular mine) cannot be efficiently combusted in boilers designed for coal from another source. Therefore, coal is not as uniform a fuel as is, for example, #6 fuel oil.

The inefficient and expensive handling, tranportation and storage of the solid material has made the conversion of oil-fired system to coal less economically attractive. Liquids are much more easily handled, transported, stored and fired into boilers. Because of this nation's dependence on oil and natural gas, existing fuel transportation systems in the U.S., from pipelines to ocean-going tankers, are designed for liquids and gases.

Various methods, for the most part not economically viable, have been proposed for converting coal to synthetic liquid or gaseous fuels. Recently developed process technology permits the conversion of coal to synthetic liquid or gaseous fuels at the mine site. While this "synfuel" is more easily transported than coal, the conversion process is capital intensive and requires a great deal of water. The process is also very energy intensive in that essentially every carbon atom in the coal matrix is converted to a hydrocarbon. Despite the high processing costs, the resultant synfuel, like crude oil derived fuels, is valuable as a transportation fuel.

Methods for creating coal slurries or mixtures which facilitate liquid transport and fluidic firing into boiler systems have been proposed but not have been completely successful. To produce a slurry, raw coal is ground, sized, slurried with water or other liquid, and stabilized. The goal is to obtain a product which handles like a liquid, not only facilitating the transportation step itself, but also reducing labor costs and eliminating the many other handling problems of solids and reducing the capital costs required to convert oil-fired systems to use solid coal.

Coal slurries are comprised of ground coal particles which have jagged, nonsymmetrical shapes due to fracturing along crystal faces. This configuration not only is abrasive to conduit systems but also adversely affects the loading limits and flow characteristics of any resultant slurry. Since coal is the main fuel constitutent in such slurries, furnace and stack modifications are still required in order to burn coals from different regions. Non-aqueous liquids used for slurrying (including alcohol) tend to solubilize impurities in the coal. These impurities tend to combine with the liquid medium and form polymerized materials which "varnish" pipelines and alter rheology characteristics.

Previous coal slurries have required special pipelines and pumping equipment. Aqueous coal slurries have additional drawbacks: (1) The water which is necessary to slurry coal is in short supply for coal reserves in the intermountain West. (2) Water must be removed from the slurry and the coal must be dried prior to introduction of the fuel into a furnace or boiler to avoid incurring a substantial heat penalty. (Derating of the boiler) (3) Dewatering and disposal of the slurry water creates a pollution problem.

Liquids other than water, such as alcohol, may be used as the slurrying liquid but are expensive and usually require water for manufacture. In addition to being abrasive, coal slurries tend to settle upon standing, thereby causing flow problems in pipelines and ballast problems aboard ships.

While coal/water slurries and coal/alcohol slurries require substantial system modification in order to be fired in existing oil-fired combustion systems, coal/oil mixtures ("COM") are able to be burned in existing coal-fired furnaces, boilers and process heat generators without substantial equipment modification. COMs, which comprise a pulverized, comminuted or ground coal admixed with oil, may contain various additives to, for example, increase the wetability of the coal, stabilize the mixture, etc. This fuel mixture, while capable of being transmitted by pipeline, requires special handling and pumping equipment. These COMs have received extensive attention in the past decade but they are not new. U.S. Pat. No. 219,181, issued Feb. 24, 1879 to Smith, H. R. and Munsell, H. M. discloses the basic coal/oil mixture and their use. COMs, while generally having a higher BTU content per unit volume than either coal or oil alone, have serious drawbacks. First, the oil used as the slurry medium draws from the U.S. domestic or foreign supply of crude oil; therefore, it only partially cuts down on this country's foreign oil dependence and reduces our balance of trade deficit. Second, there are severe restrictions on the export of oil even as a coal/oil mixture, thus there is a limited foreign market. Third, crude oil is expensive and, with the additional slurrying expense, the cost savings to an oil-fired system are marginal. Finally, these COMs have all the inherent drawbacks of coal-containing slurries.

Although coal/water slurries have not been altogether successful and require substantial amounts of water, which requirement is not easily met in the intermountain west, nevertheless, highly loaded water slurries without the inherent drawbacks previously discussed would have viability in non-arid regions. This would be especially true if the physical structure of the carbonaceous material were conducive to transport in a slurry and if such material were a uniform combustion product sufficiently high in BTU to offset the heat penalty experienced during combustion of the aqueous slurry.

Thus it would be highly advantageous to have a fluidic fuel system which is easily and efficiently prepared from coal and which would be (a) transportable using certain existing pipeline, tank car and tankership systems, (b) burnable either directly as a substitute for oil in substantially all existing oil-fired combustion systems or separable at the destination to provide a burnable carbonaceous material, (c) a uniform combustion product regardless of the region from which the coal is obtained, (d) high in BTU content per unit volume, (e) low in ash, sulfur and nitrogen, (f) high in solid loading and stability, (g) free of polluting process by-products which would have to be disposed of at the production site and (h) produced as part of a process which also yields a high quality liquid organic material which is pipeline transportable and can be used as a liquid fuel or as a quality feedstock material.

DISCLOSURE OF THE INVENTION

It has been discovered that a fluidic fuel system comprising a particulate coal char slurried in water provides a pipeline transportable fuel composition which has high BTU per unit volume, is low in pollutants, and is a substitute for petroleum derived fuel in liquid-fueled combustion devices or can be dewatered at the destination to provide a combustible solid as a fuel for solid-fueled combustion devices. The by-product of the production of char is a high quality, liquid organic material which may be used in combustion devices or as a feedstock.

In the broad aspect of the invention, a liquid-solid mixture includes a particulate coal char portion dispersed in water to create a composition which has fluidic characteristics such that it can be transported by certain pipeline facilities and used directly in combustion systems. In one aspect, the liquid/solid mixture is a substitute for oil in liquid-fueled combustion devices. In another aspect, the mixture is dewatered and the particulate coal char is used as a fuel in char- or coal-fired combustion devices. The liquid organic fraction produced in forming the char is utilized as a feed stock or as a high quality liquid fuel for liquid-fueled combustion devices. In a further aspect, that portion of char which is not admixed with the water can be used directly as a feed for solid-fueled combustion devices. Advantageously, a portion of the liquid organic fraction produced during pyrolysis can be admixed with the char to enhance combustion characteristics.

In a further aspect, the particulate coal char can be admixed with raw coal, upgraded coal, petroleum coke and the like to yield a high BTU, reduced pollutant fuel for char- or coal-fired combustion devices. Likewise, the liquid organic fraction can be used itself as a fuel or admixed with a liquid petroleum distillate or lower and/or medium chain alcohols, such as those produced from grain, in order to vary the charactistics of the liquid as a fuel or as a feedstock.

The liquid organic fraction is derived during the pyrolysis or hydropyrolysis of the coal. It may be further hydrogenated to alter the viscosity. Advantageously, the liquid organic fraction may be beneficiated.

The fuel composition of the instant invention can be produced by subjecting coal to pyrolysis or hydropyrolysis in the absence of oxygen to produce a particulate coal char which is admixed in suitable proportions with water to produce a solid/liquid fluidic mixture, i.e., a slurry.

In accordance with one aspect of the invention, the fludiic fuel composition is produced by first subjecting coal to pyrolyitic or hydrophyrolytic destructive thermal distillation in the absence of oxygen to produce a particulate coal char. The char is sized and otherwise mechanically and thermally treated to yield a particulate coal char of a distribution to advantageously effect loading of the solid. The liquid organic fraction obtained from the pyrolysis or hydropyrolysis of coal forms a completely combustible hydrocarbon fuel suitable for pipeline transport, combustion directly in combustion systems and/or use as a chemical or refinary feedstock. Advantageously, this liquid organic fraction may be hydrotreated to reduce viscosity and beneficiated to remove sulfur or nitrogen pollutants.

In accordance with another embodiment, the liquid organic fraction is admixed with a lower chain alcohol which is preferably produced by well known synthetic methods utilizing coal and water or natural gas. In accordance with a preferred emboidment, the alcohol is produced from the gases liberated in the pyrolysis process, thus producing all the fuel system components, expect the water, from a single, completely self-contained process system.

The utilization of a particulate char allows a high packing of the solid particulate matter for a given fluidity of the mixture. Thus, not only does one obtain the aforementioned advantages, but the energy requirement necessary to pump each BTU of fuel energy is significantly reduced. In a further advantageous embodiment, the char is ground and sized to yield a particulate distribution which is bimodal or trimodal. The use of a bimodal or trimodal particulate char distribution enhances the packing of the solid.

In accordance with another embodiment of the instant invention, an amount of pulverized coal is added to the particulate coal char/water slurry. In accordance with this embodiment, the coal is pulverized so as to provide bimodal or trimodal packing with the char. This improves the combustion characteristics of the slurry in some combustion applications without the expense of processing all the coal by pyrolysis. The amount of coal which is added is effective to improve the combustion characteristics without adversely affecting the beneficial aspects of the particulate coal char/water mixture. Addition of coal to the slurry prior to transport is economically attractive in that grinding and sizing facilities at the slurry preparation site already exist.

In addition to the char and liquid organic fraction, the pyrolysis or hydropyrolysis produces gaseous products. These gases contain combustibles, lower chain hydrocarbons, hydrogen, carbon monoxide, ammonia, and sulfur and nitrogen oxide. The gases are useful for the extraction of marketable by products such as ammonia, and for use as a hydrogen source for hydropyrolysis, as a fuel for use in combustion systems and as a feedstock for the production of lower chain alcohols for use as viscosity modifiers for hydrocarbon liquids. Advantageously, the pyrolysis gases are "sweetened" prior to being marketed or used in the process. The elimination of potential pollutants in this manner not only enhances the value of the char and liquid hydrocarbons as non-polluting fuels but also improves the economics of the process as the gaseous products may be captured and marketed or utilized in the process. In accordance with a preferred embodiment, these gases are used primarily to produce lower chain alcohols which are admixed with the liquid organic material to improve the viscosity characteristics of the liquid.

In accordance with the instant invention, the fuel system, which advantageously comprises the transportation medium for the fuel to its end use, can be injected directly into the combustion chamber of a liquid-fueled combustion system in the presence of sufficient oxygen and heat to initiate and sustain combustion. The combustion products are then exhausted from the combustion chamber.

Alternatively, some or substantially all of the solid can be removed from the slurry and, either as the sole fuel or in an admixture with coal, fired directly into char- or coal-combustion devices. In a particularly preferred embodiment when the char, liquid organic fraction and gas are produced by pyrolysis, a portion of the liquid organic material, preferably a high boiling fraction, is admixed with the char or the char/particulate coal admixture in order to enhance the heat value of the solid fuel, to prevent absorption of moisture and the facilitate combustion. In another aspect, a portion of the liquid organic fraction can be admixed with the particulate coal char/ water slurry to form a hydrocarbon/water liquid phase to enhance the burning characteristics as a fuel for a liquid-fired combustion device. Preferably, surfactants and suspension agents are used to create a hydrocarbon/water (oil/water) emulsified liquid system.

BEST MODE FOR CARRYING OUT THE INVENTION

In accordance with the preparation of the particulate coal char/water slurry that is utilized in accordance with the instant invention, raw coal is continuously crushed to particles in the range of $\frac{1}{2}''$ to $\frac{1}{4}''$ in diameter to produce a crushed coal product. Advantageously, the crushed coal is then washed and otherwise beneficiated by means well known in the art to remove inorganics. This process and the size of the coal particle to be beneficiated will be dependent on the rank of the coal, its agglomerating tendencies and the inorganic sulfur and ash content of the coal. The coal is preferably preheated to remove moisture and entrained gases which are advantageously used in the process. The crushed coal is then pyrolyzed or hydropyrolyzed under temperatures and pressures and in accordance with process conditions to produce a particulate coal char. The pyrolysis provides for thermal destructive distillation of the coal in the absence of oxygen to produce a particulate char portion and a liquid organic fraction. Advantageously, the char portion may be further beneficiated to remove inorganic pollutants and mechanically and thermally treated to size the particulate char product which is efficacious for bimodal and trimodal packing. The sized char mixture is then ready to be slurried.

The liquid organic fraction derived during the pyrolysis of the coal may be advantageously separated by fractional distillation into a higher boiling fraction containing the bulk of the nitrogen and a lower boiling fraction. The higher boiling fraction can be further hydrogenated to decrease viscosity or sent to storage for use directly as a chemical reagent and feed stock. In accordance with one aspect, at least a portion of the higher boiling fraction is admixed with the char to from an enhanced solid fuel for use, without slurrying, directly in, for example, a mine mouth boiler. The lower boiling fraction is rendered substantially free of combined and entrained materials which, on combustion, would produce sulfur oxides, nitrogen oxides and like pollutants. The lower boiling fraction can be distilled to remove gasoline and other valuable hydrocarbon fractions which can be used directly as transportation fuels. The remaining lower boiling fraction is added to the upper boiling fraction.

The char is slurried with water. The exact mixture of liquid to solid will depend on a number of factors such as the characteristics of the liquid-fueled combustion device in which it is to be used, the transportation, medium limitations and the like. The transportable particulate coal char/water slurry composition is passed to storage for later distribution by pipeline or tanker vehicle in a manner similar to crude oil.

The coals that can be employed in accordance with the instant invention are, generally, any coal which will undergo pyrolysis to form a particulate coal char. Preferably, coal from the lignite rank to the medium volatile bituminous have sufficient volatiles so as to maximize hydrocarbon production and minimize added water requirements. When lignites are utilized, they are advantageously subjected to pretreatment to remove residual water. This water is used as process water and/or water for slurrying the char. Lignites are an advantageous starting material for the instant invention in that they contain process water for hydropyrolysis and/or process water as well as volatiles up to 55% by weight (on a dry basis). This is advantageous in obtaining the hydrocarbon-rich liquid organic fuel or feedstock.

The physical properties of the coal are also important in the practice of the instant invention. Those coals known a caking or agglomerating coals tend to form "cokes". Other coals of higher rank have plasticity and free swelling characteristics which tend to cause them to agglomerate and slake during the pyrolysis process. These coals must be subjected to special charring and treatment conditions as further set out herein to produce the particulate coal char suitable for use in accordance with the instant invention.

The mining and preparation of coal is fully described in Kirk-Othmer ENCYCLOPEDIA OF CHEMICAL TECHNOLOGY, second edition, Anthony Standin, editor, Interscience Publishers, New York, 1969, vol. 5, pp. 606–676. The coal is mined from a coal mine by either strip or underground methods as appropriate and well known in the art.

The raw coal is preferably subjected to preliminary crushing to reduce the particle size. Particle sizes of from $\frac{1}{4}''$ to about $\frac{1}{2}''$ in lateral dimension (diameter) are found useful but the actual sizing is dependent on the properties of the coal as well as the need for beneficiation. The need for size reduction and the size of the reduced material will depend upon the process conditions utilized as well as the composition and rank of the coal material. When beneficiation is necessary, for example, with coals containing a high percentage of ash or inorganic sulfur, the coal is preferably ground and subjected to washing and beneficiation techniques. When coals are used which have agglomerating tendencies, the size of the coal must be matched to the pyrolysis techniques and process conditions in order to produce a particulate coal char and to prevent slagging and/or agglomeration during pyrolysis. The crushing and/or grinding is preferably accomplished with impact mills such as counter-rotating cage mills, hammer mills or the like. The crushed coal is sized by, for example, rough screening and gangue material is removed to assure a more uniform product for pyrolysis. Advantageously, carbonaceous fines and the like are readily utilized and subjected directly to pyrolytic destructive distillation.

In accordance with a greatly preferred embodiment, the crushed coal particles are then passed continuously through a preheater, which is operated in the range of from about 0.1 atmospheres to about 20 atmospheres and from about 100° C. to about 220° C. in order to remove gases and moisture. In many situations it has been found advantageous to employ a vacuum and/or mechanical manipulation to liberate moisture and gases in accordance with the instant invention. The moisture is advantageously used as process water for slurrying and for the hydropyrolysis and/or hydrotreating steps as further set forth herein. The entrained gases which are removed have further value as fuel or a hydrogen source for the hydropyrolysis step or preferably as a feedstock for production of lower chain alcohols. Advantageously, the preheating is carried out using process heat from the char and hot gases liberted during pyrolysis. The preheating is preferably done at lower temperatures to minimize slagging and agglomeration.

Pyrolysis, as used herein, means the destructive distillation of coal in the absence of oxygen, and may be performed in the presence of one or more hydrogen donors or hydrogen itself. "Pyrolysis" thus includes pyrolysis, hydropyrolysis, and steam pyrolysis as well as carbonization techniques under varying temperature and pressure and atmosphere conditions such as, for example, in the presence of hydrogen, water vapor or hydrogen-donading material. The pyrolysis step of the instant invention can be carried out by any pyrolysis apparatus, which is well known in the art, having the ability to reach charring temperatures in the requisite time. For example, with subbituminous coals, temperatures should be in the range of from about 400° C. to about 800° C. and a heating rate of from about 1.5° C. per second to about 2.5° C. per second should be employed. Coals of higher rank require progressive heating at rates which prevent agglomeration and at higher final temperatures in the range of 1000° C. depending on the atmospheric pressures. It will be realized by the skilled artisan that, depending on the composition of the charge, the residence time, the pyrolysis process used and the charring furnace utilized, the temperatures and rates may vary. Preferably, the pyrolysis is performed in a continuous process.

As the crushed coal is heated in the absence of oxygen, the entrained materials are vaporized and collected. Lower boiling organic fractions including hydrocarbons, cyclics, and aromatics as well as higher boiling organic fractions are emitted from the coal leaving a particulate char material of essentially carbon which is of a porous structure and substantially spherical in shape. Included in the emitted constituents are the nitrogen containing polluting compounds such as pyridine, piperazine and the like.

The preferred method of thermal destructive distillation in the absence of oxygen is hydropyrolysis. Hydropyrolysis is advantageously employed when treating coal containing a lower percentage of volatiles or when a higher percentage of hydrocarbon liquids is desired. In accordance with this process, the pyrolysis is carried out in the presence of a hydrogen containing source which may be water or the pyrolysis gases which are subjected to standard phase shift reactions.

The liquids hydrotreating step is quite well developed. A number of such technologies are readily available in the art. The parametric aspects of the pyrolysis conditions. determine the char yield and the yield and composition of the liquids. Of the numerous pyrolysis technologies available, three are particularly applicable to the instant invention. They are a fluidized bed; an entrained flow reactor; and the pyrolysis/hydrotreater. The last is deemed preferable when the liquid organic material is to be further treated to adjust viscosity since it allows the sequential pyrolysis of coal and hydrotreating of the liquid.

In practicing the process of the instant invention in a continuous mode, it has been determined that recycling the hot char to the pyrolyzer conserves energy and has a beneficial effect on the pyrolysis products. The reactor temperature and the residence time are variable factors used to produce greater yields of char and/or liquid organic material, as well as obtaining a hydrocarbon mix of desirable viscosity. The process can be "fined tuned" depending on the rank of the coal (i.e., percent volatiles agglomeration, etc.).

The char may be efficaciously sized and beneficiated. It is very important, in order to obtain the requisite liquid/solid mixture, that the coal char be discrete, particulate char. When utilizing agglomerating or "caking" coals, preferably the process parameters are regulated so as not to produce an agglomerated product as previously set forth herein. Further, the coal char material may be emitted from the charring apparatus as discrete particles which are stuck together depending on the starting material and the pyrolysis conditions utilized. Therefore, the char material is ground to yield the substantially spherical, properly sized particulate coal char. Any conventional crushing and grinding means, wet or dry, may be employed. This would include ball grinders, roll grinders, rod mills, pebble mills and the like. Advantageously, the particles ae sized and recycled to produce a desired distribution of particles. This is a very important aspect of the instant invention. The char particles are of sufficient fineness to pass a 100 mesh screen and the majority of the particles pass a 300 mesh screen. The mesh sizes refer to the Tyler Standard Screens. In accordance with the instant invention, char particles in the 100 mesh range or less are preferable. It will be realized that the particulate char of the instant invention having particle sizes in the above range is important to assure not only that the solid is high in reactivity, but also that the slurry is stable and can be pumped as a fluidic fuel into combustion system. The exact distribution of particle sizes is somewhat empirical in nature and depends upon the loading and stabilizers.

The ground, beneficiated char can be sized by any apparatus known in the art for separating particles of a size on the order of 100 mesh or less. Economically, screens or sieves are utilized, however, cyclone separators or the like can also be employed. In sizing, selections are made so as to assure a stable, pipeline transportable slurry and uniform combustion. A distribution of particle size is chosen to effect so called "modal" packing. The spheriod shape of the primary particle provides spacing or voids between adjacent particles which can be filled by a distribution of second or third finer particle sizes to provide bimodal or trimodal packing. This modal packing technique allows addition of other solid fuel material such as coal to the slurry without affecting the very advantageous pumping characteristics of the particulate coal char/water slurry of the instant invention. Additionally, this packing mode allows the compaction of substantially more fuel in a given volume of fuel mixture while still retaining good fluidity.

The char may be beneficiated. When beneficiation is indicated because of the inorganics present, beneficiation may be utilized to clean either the coal or the char. The beneficiation can be performed by any device known in the art utilized to extract pollutants and other undesirable inorganics such as sulfur and ash. The char has a high degree of porosity which enables it to be readily beneficiated. Beneficiation may be accomplished, for example, by washing, jigging, extraction, flotation, chemical reaction, solvent extraction, oil agglomeration (for coal only) and/or electro-static separation. The latter three methods remove both ash and pyritic (inorganic) sulfur. When the solvent extraction or oil agglomeration methods are used, it is most advantageous to utilize the liquid derived from the pyrolysis process as the beneficiating agent. The exact method employed will depend largely on the coal utilized in forming the char, the conditions of pyrolysis, and the char size and porosity.

The chars which can be utilized in accordance with the instant invention have a high reactivity and surface area, providing excellent Btu to weight ratios. The char particles are sufficiently porous to facilitate beneficiation and combustion but the pore size is not so large as to require the use of excessive liquid for a given amount of solid. The spherical shape allows adjacent particles to "roll over" one another, therefore improving slurry rheology and enhancing the solid loading characteristics. Preferably, chars that can be employed are discrete spherical particles which typically have a reaction constant of from about 0.08 to about 1.0; a reactivity of from about 10 to about 12; surface areas of from about 100 microns to about 200 microns; pore diameters of from about 0.02 milimicrons to about 0.07 milimicrons; and pass 100 mesh, and preferably, 200 mesh.

The resultant sized, particulate coal char mix may be conveyed by means of, for example, an air conduit to be "slurried" in appropriate proportion with water.

The liquid organic fraction may be hydrotreated and/or beneficiated, as necessary, to provide a lower viscosity pollutant free organic fraction. The exact amount of this fraction utilized will depend upon the end-use properties desired. In accordance with a greatly preferred embodiment, the low boiling transportation fuels such as aviation gasoline, kerosene, naptha and the lighter diesel fuels are separated from the liquid organic fraction prior to transporting the liquid organic fraction when the liquids are to be used as a liquid fuel. These transportation fuels, which are pipeline transportable, can be marketed separately, thereby greatly improving the economics of the process.

The higher boiling fractions of the liquid organic fraction may contain certain sulfur and nitrogen compounds. This fraction may be removed by fractional distillation and used directly as a feedstock for chemical synthesis. Alternatively, it may be hydrotreated and beneficiated by methods well known in the art to reduce the viscosity and remove pollutants. Advantageously, the pyrolysis and hydrotreating can be accomplished sequentially, followed by beneficiation in accordance with the procedure previously disclosed herein.

The particulate char and water are admixed in the desired portion to form a slurry. An admixture is thus formed of a particulate coal char and water having a ratio of particulate char to liquid which is dependent upon the properties of the slurry desired.

The terms "slurry" or "liquid/solid mixture" as used herein are meant to include an aqueous composition containing an amount of the particulate coal char. For most applications, however, the particulate coal char constituent should comprise not less than about 45% by weight of the composition and preferably from about 45% to about 75% by weight.

In accordance with another aspect of the instant invention, particulate char produced from certain ranks of coal have pore sizes and absorption characteristics such as to require treating of the char prior to slurrying of the particulate char with the water to reduce absorption by the char of the liquid phase. This treatment serves to stabilize the slurry and prevent absorption by the particulate char of an excess of the slurry water. When absorption rates by the char are in excess of about 7%, pretreatment is very beneficial. It will be realized that absorption of the water by the char reduces the heating value of the fuel.

In accordance with this pretreatment, the char is brought into intimate contact with an amount of a the coating or "sealing" material effective to reduce the absorption of liquid by the char. The treatment is effected prior to the particulate char being slurried with the liquid. The sealants or coatings that are useful include organic and inorganic materials which will not produce pollutants upon combustion. Since surfactants and emulsifiers are used to enhance slurry stability, care must be taken that the coating or sealant is compatible with the stabilized composition. Sealants and coating materials which are particularly advantageous include parafins and waxes as well as the longer chain aliphatics, aromatics, polycyclic aromatics, aro-aliphatics and the like. Mixtures of various hydrocarbons, such as #6 fuel oil, are particularly desirable because of their ready availability and ease of application. Advantageously, the higher boiling liquid organic fraction from the pyrolysis of the coal are utilized. The sealant or coating can be applied to the char by spraying, electrostatic deposition or the like.

In accordance with another aspect of the instant invention, a portion of the char produced by pyrolysis of coal can be used directly, without slurrying, as a solid combustion fuel. Preferably, the char which is not slurried is admixed with an amount of the liquid organic material effective to enhance the combustion characteristics of the char while maintaining the char substantially as a particulate solid matter, i.e., not a fluidic mixture. In this embodiment preferably the higher boiling "tar" fractions are used. These fractions adhere well to the hot char and provide a "sealant" to prevent moisture absorption during transport. They are also high in heat value per unit volume.

In accordance with another embodiment of the instant invention, coal or the pyrolysis gases, and water are utilized to produce methanol and other lower chain alcohols which are utilized to enhance the viscosity of the organic liquid. Water released from the coal during preheating can be used as part of the water required in the synthesis.

As used herein the term alcohol is employed to mean alcohols (mono-, di- and trihydroxy) which contain from 1 to about 4 carbon atoms. These include, for example, methanol, ehtanol, propanol, butanol and the like. The alcohol may range from substantially pure methanol to various mixtures of alcohols as are produced by the catalyzed reaction of gases derived from pyrolysis or natural gas. Advantageously, the alcohol constituent can be produced on site at the mine in conjunction with the pyrolysis. The process heat can be supplied from the cooling of the pyrolysis products.

In accordance with the process for making these alcohols directly from coal and steam, carbon monoxide and hydorgen are initially formed in accordance with equation I:

$$\text{HOH (steam)} + \text{C (coal)} \rightarrow \text{CO} + \text{H}_2. \qquad \text{I.}$$

A portion of the gas is subjected to the shift reaction with steam to produce additional hydrogen in accordance with equation II:

$$\text{CO} + \text{HOH (steam)} \rightarrow \text{CO}_2 + \text{H}_2. \qquad \text{II.}$$

The $CO_2$ is scrubbed from the gaseous product leaving only hydrogen. The hydrogen is admixed with gaseous products of equation I to produce a gas having desired ratio of hydrogen to carbon monoxide from which methanol and similar products are synthesized catalytically. Preferably, the gas having the desired ratio of hydrogen to carbon monoxide is produced during the coal pyrolysis, and more preferably by hydropyrolysis. In accordance with this aspect of the instant invention, the raw pyrolysis gas which contains water vapor is subjected to sulfur and nitrogen removal as previously disclosed. The $H_2$ and CO are then separated by, for example, cryogenic means and converted to methane. The methane, ethane and higher hydrocarbon gases are converted to the alcohols.

In the methanol synthesis plant the respective constituents, such as carbon monoxide and hydrogen, are combined to produce methanol. The synthesis of methanol is described in page 370–398 of vol. 13 of the above referenced KIRK-OTHMER ENCYCLOPEDIA. The carbon monoxide and hydrogen are controlled in a ratio and temperature pressure combination to obtain maximum yields of the methanol fuel product. Other methods for methanol synthesis at lower temperatures and pressures are also known, as for example, the ICI low pressure process as described in "Here's How ICI Synthesizes Methanol at Low Pressure", Oil and Gas Journal, vol. 66, pp. 106–9, Feb. 12, 1968. In accordance with this aspect of the instant invention, the alcohol is used as a portion or substantially all of the liquid phase in the slurry.

In accordance with another aspect of the instant invention, the particulate char solid can be supplemented by an amount of particulate carbonaceous material such as coal, effective to improve combustion characteristics without detrimentally affecting the beneficial aspects of the uniform combustion slurry product. Specifically, applicant has disclosed that coal-water mixtures contain coal and, therefore, suffer many of the drawbacks of coal-containing slurries. In accordance with the instant invention, it has been found that certain amounts of particulate coal can be added to the particulate coal char/water slurry with beneficial effect. Coal, as used in this aspect, means raw coal of bituminous, subbituminous and anthracite rank as well as upgraded coals, petrolelum coke and the like. Preferably, coals containing higher ash and inorganic sulfur are beneficiated by methods disclosed hereinbefore prior to their introduction into the slurry. Upgraded coals include those which have been thermally dried or compressed under heat and mechanical pressure to effect a slight carbonization of the coal (so-called carbonized coal) such as K-Fuel® (process disclosed in U.S. Pat. No. 4,052,168). Surprisingly, where the coal is properly sized and "packed" with the particulate char, the rheology characteristics of the particulate coal char/water slurry are not greatly affected. Practice of the invention in accordance with this embodiment is advantageous when firing the coal char/water slurry into combustion systems in which char, because of its higher ignition point, is not fully combusted. The coal ignition helps to raise the temperature of certain combustion system configurations to facilitate char ignition. Additionally, use of pulverized coal is economically advantageous in that the coal portion of the slurry does not have to undergo pyrolysis. The amount of coal that can be used in accordance with the invention will depend on the particular properties of the coal, but for many applications, up to 50% by weight of the solid constituent of the slurry can be coal and advantageously up to about 30% by weight of the solid.

The mixing (or slurrying) of the solid particles and the water can be accomplished by any well known mixing apparatus in which water and a particulate coal char can be mixed together in specific proportion and pumped to a storage tank. Advantageously, emulsifying techniques are used, such as high speed empellers and the like.

The important aspect of the slurry in the instant application is that it is pumpable and stable. This is accomplished by matching the size of the solid char particle, the viscosity of the liquid phase and the stabilizer. In a further embodiment, a weight percent of from about 2% to about 25% of the liquid organic material produced form pyrolysis and/or synthesis of alcohol is admixed into the slurry. This is especially preferable when surfactants which have lipophyllic moieties are used. The addition of the liquid organic fraction/ water phase preferably forms an emulsion to prevent separation. This embodiment greatly enhances the heating value of the slurry when fired directly into liquid-fueled combustion devices. In a greatly preferred embodiment, the liquid organic fraction and the char are first admixed and the resultant composition then slurried with water. The slurry is preferably agitated or blended to produce a suspensoid which is stable under shear stress, such as pumping through a pipeline. Since use of the liquid organic fraction enhances the heating value of the slurry, the amount which can be used is somewhat empirical depending on end-use applications as well as fuel composition stability during transportation and storage.

It will be realized that, in accordance with the instant invention, surfactants, suspension agents, organic constituents and the like may be added depending on the particular application. Certain well known surfactants and stabilizers may be added depending on the viscosity and non-settling characteristics desired. Examples of such substances which are useful in accordance with the instant invention include dry-milled corn flour, gelatinized corn flour, modified cornstarch, cornstarch, modified waxy maize, guar gum, modified guar, polyvinyl carboxylic acid salts, zanthum gum, hydroxyethyl cellulose, carboxymethyl cellulose, polyvinyl alcohol and polyacrylamide. As hereinbefore mentioned, advantageously the admixture of the instant invention demonstrates high fluidity. Thus high Btu per unit volume is obtained with lower viscosities and higher fluidities.

As previously set forth, the sizing and packing of the slurry is particularly important in obtaining a highly loaded, stable, transportable combustion fuel. It has been found advantageous to have greater than about 50% of the solid material smaller than about 100 mesh (Tyler) and over about 80% of that passing a mesh size in the range of 300 (Tyler).

The fuel composition of the instant invention can be mobilized or transported by conventional means used for crude oil transportation, permitting the efficacious foreign export of coal derived fuels which has not heretofore been readily and economically accomplished. For example, the existing pipelines to docks and tanking facilities can readily be utilized. Oil tankers can empty their crude oil load in this country, and be refilled with the particulate char-containing fluidic fuel system of the instant invention which can be exported to other nations, thus improving the balance of payments of this country.

The high BTU, non-polluting fluidic fuel system, upon reaching its ultimate destination, can be employed directly as a substitute for petroleum derived fuels (1) for heating; (2) for power generation; or (3) in mobile combustion units.

Alternatively, the liquid and solid components can be separated so that substantially all of the solid portion of the slurry is removed from the water. After separation, the solid component can be used as a fuel for solid-fueled combustion systems.

The separated char (or carbonaceous material/char mixture if carbonaceous material has been added to the slurry system) can be burned alone or with a mixture of particulate carbonaceous material such as raw coal, upgraded coals, coke, petroleum coke or the like in standard solid-fueled combustion systems. By admixing the char with one or more of these carbonaceous materials, a high quality compliance product can be obtained even if the admixed material is low in BTU and/or high in sulfur.

It will be realized that the liquid organic fraction, when used as a fuel, can be combusted alone or combined with liquid petroleum distillates as previously disclosed and/or lower to medium chain alcohols having from 1 to about 10 carbon atoms, such as those produced from grain or from coal or bio-waste synthesis processes or the raw gas as previously described, to enhance certain fuel characteristics for a particular application.

In accordance with a further aspect of the instant invention, the solid particulate char which is not admixed with water to form the slurry can be used independently as a combustion fuel. In accordance with this aspect, some or a substantial portion of the char produced in pyrolysis or hydropyrolysis can be used directly as a fuel for solid-fueled combustion devices. In accordance with this aspect, the char to be fired directly as a solid fuel need not be ground or sized. It may be mixed with other particulate carbonaceous material and transported to the end-use destination by rail car, truck or the like. Advantageously, the char is transported pneumatically. In a particularly advantageous embodiment, the hot char is fed directly to a mine mouth combustion system, either with or without the addition of coal, upgraded coal and the like. Preferably, this is accomplished by means of a pneumatic conveyance device. In accordance with a further aspect of this embodiment as previously set forth herein, an amount of the liquid organic fraction which is effective to enhance combustion characteristics and prevent moisture absorption can be admixed with the char. Preferably, the higher boiling liquid organic fractions are used. This helps to reduce the viscosity of the remaining liquid material.

In the aspect where the hot char is fed directly to a mine mouth combustion device and the higher boiling fraction is used to admix with the char to enhance the combustion characteristics, some or a substantial portion of the liquid organic material may be used as a liquid fuel or as a feedstock. As previously described, certain lower boiling fractions such as gasoline and distillates are removed for use directly as transportation fuels. These fuels are transported in the pipeline by use of plugs and the like to refineries or to combustion systems requiring high grade fuels. A substantial portion of the liquid organic fraction is economically transported by means of, for example, the slurry pipeline with plugs or by tanker truck for use directly as a fuel for liquid-fueled combustion devices or as a feedstock. It will be realized that the liquids can first be "cracked" or hydrotreated to enhance their value as a fuel.

Combustion systems designed for burning coal-water mixtures will utilize the fluidic fuel system of the instant invention most readily. Char has a high ignition point than coal but is more reactive. It will be realized by the skilled artisan that modification to oil-fired systems may be necessary to avoid substantial boiler derating if the fuel system of the instant invention is fired directly into the combustion system.

It will be further realized that the above fuels, either individually or in combination, can be combusted in combustion devices using oxygen. Oxygen, as that term is used herein, means an atmosphere of pure oxygen or an atmosphere having a partial pressure of oxygen such as, for example, air.

Char- or coal-fired combustion devices, with little or no modification, can burn the particulate coal char portion of the slurry which serves as the solid component of the fuel system. Coal, either carried in the fluidic fuel system or added to the char after separation will allow a "tuning" of the solid fuel to any coal-fired combustion system. Because the char is beneficiated, coals of higher sulfur and/or lower BTU can be blended with the char to effect a compliance mixture with no derating of the boiler system.

A particularly advantageous aspect of the instant invention relates to the flexibility of the instant transportable fuel system. The transportable fuel system can be "adjusted" or "fine tuned" during the process, prior to transportation or at the end-use facility. The system of the instant invention facilitates transporting coal-derived fuels to both liquid fueled and solid fueled combustion systems as well as providing a useful hydrocarbon feedstock. The fuel is uniform and non-polluting. The solid components can be beneficiated to remove harmful constituents, thus avoiding the $SO_2$ and $NO_x$ pollutants linked with acid rain as well as ash related boiler slagging problems. There is no preclusion against exporting the slurry or the liquid organic material and export is readily accomplished using conventional transportation means for liquid fuels. The fuel system utilizes all ranks of coals, including lower ranks and coals not previously thought economically viable. Most importantly, unlike coal, the solid fuel is a uniform combustion product.

While the invention has been explained in relation to its preferred embodiment it is understood that various modifications thereof will become apparent to those skilled in the art upon reading the specification and the invention is intended to cover such modifications as fall within the scope of the appended claims.

We claim:

1. A fluidic, substantially non-polluting fuel system comprising a liquid/solid mixture, including a portion of a particulate coal char, dispersed in an amount of water effective to produce a transportable composition wherein said particulate coal char is treated with a sealant effective to reduce absorption of water.

2. The fuel system of claim 1 further comprising a minor portion of a particulate carbonaceous material selected from the group consisting of raw coal, upgraded coal, petroleum coke and mixtures thereof wherein said particulate carbonaceous material is treated with a sealant effective to reduce absorption of water.

3. The fuel system of claim 1 wherein at least a portion of the solid is separated from said liquid/solid mixture at the destination for use as a solid fuel.

4. The fuel system of claim 2 wherein at least a portion of the solid is separated from said liquid/solid mixture at the destination for use as a solid fuel.

5. The fuel system of claim 1 wherein the solid is at least partially derived by the pyrolysis of coal and wherein there are simultaneously produced liquid and gaseous hydrocarbon materials.

6. The fuel system of claim 5 wherein said liquid/-solid mixture further comprises a portion of a liquid selected from liquid hydrocarbon materials derived from said pyrolysis, liquid petroleum distillates, lower and medium chain alcohols having from about 1 to about 10 carbon atoms, and mixtures thereof.

7. The fuel system of claim 6 wherein said liquid hydrocarbon material is present in sufficient quantity to form a hydrocarbon/water liquid phase.

8. The fuel system of claim 1 wherein the solid portion is sized and treated to effect bimodal or trimodal packing thereof.

9. The fuel system of claim 2 wherein the solid portion is sized and treated to effect bimodal or trimodal packing thereof.

10. The fuel system of claim 1 wherein said sealant is derived from pyrolysis liquids and is effective in enhancing the heat value of the solid fuel.

11. A method of producing a fluidic fuel system comprising the steps of admixing a particulate coal char with an amount of water effective to produce a transportable liquid/solid mixture wherein said particulate coal char is treated with a sealant effective to reduce absorption of water.

12. The method of claim 11 comprising the further step of admixing with said liquid/solid mixture a portion of a particulate carbonaceous material selected from the group consisting of coal, upgraded coal, petroleum coke and mixtures thereof wherein said particulate carbonaceous material is treated with a sealant effective to reduce absorption of water.

13. The method of claim 11 comprising the further steps of transporting said system and separating from said system substantially all of the solid for use as a fuel.

14. The method of claim 12 comprising the further steps of transporting said system and separating from said system substantially all of the solid for use as a fuel.

15. The method of claim 13 wherein the particulate coal char is at least partially derived from the hydropyrolysis of coal and the liquid organic fraction produced simultaneously is used as a fuel or as a feedstock.

16. The method of claim 13 comprising the further step of admixing with said liquid/solid admixture at least a portion of a liquid selected from said liquid organic fraction, liquid petroleum distillates, lower and medium chain alcohols having from about 1 to about 10 carbon atoms, and mixtures thereof in proportion such as to from a hydrocarbon/liquid pahse.

17. A method for producing a fluidic, substantially non-polluting fuel system comprising the steps of (a) subjecting coal to pyrolysis to produce a coal char, an organic liquid and a hydrocarbon containing gas;

(b) treating the coal char to produce a particulate coal char;

(c) treating the coal char with a sealant effective to reduce absorption of water;

(d) admixing said particulate coal char and water to form said fluidic fuel system.

18. The method of claim 17 wherein said pyrolysis is hydropyrolysis and is carried out in the presence of compounds selected from the group consisting of water, hydrogendonating compounds, hydrogen and mixtures thereof.

19. The method of claim 18 further comprising the steps of beneficiating said organic liquid and said solid coal char.

20. The method of claim 18 further comprising a preheating step at temperatures in the range of from about 100° C. to about 220° C. at pressures of from about 0.1 atmospheres to about 20 atmospheres prior to said pyrolysis step and a presoaking step in the presence of a steam atmosphere at atmospheres of from about 40 to 50 atmospheres and at temperatures in the range from about 200° C. to 400° C. subsequent to said preheating step but prior to said pyrolysis step.

21. The method of claim 17 further comprising the step of admixing a particulate carbonaceous material selected from raw coal, upgraded coal, coke, petroleum coke and mixtures thereof with said coal char prior to said admixing step.

22. The method of claim 17 wherein said organic liquid further comprises a portion of an alcohol having from about 1 to about 4 carbon atoms.

23. The method of claim 17 wherein alcohol is produced by catalytic conversion of said gas.

24. The method of claim 17 further comprising the step of admixing with the solid an amount of said organic liquid, effective to prevent absorption of moisture and to enhance the combustion of the solid fuel.

25. A method of firing a combustion system comprising the steps of:

(a) injecting a combustible amount of a fuel composition into a combustion chamber wherein said fuel composition is selected from a group consisting of (1) a fluidic fuel composition comprising a solid/-liquid admixture including a portion of a particulate coal char material dispersed in an amount of water effective to produce a transportable fuel wherein said particulate coal char is treated with a sealant effective to reduce absorption of water;

(2) a solid material of particulate coal char obtained from removal of at least a portion of the solid in said solid/liquid admixture; and (3) a fluidic fuel composition comprising a solid liquid admixture including a portion of a particulate coal char material dispersed in an amount of a water/liquid organic mixture obtained from pyrolysis of coal;

(b) admixing said combustible amount of said fuel with sufficient oxygen to support substantially complete combustion, thus producing a substantially, totally combustible mixture;

(c) heating said combustible mixture to the ignition point;

(d) sustaining the combustion within said chamber; and (e) exhausting the combustion by-products from the chamber.

26. The method of claim 25 wherein said solid further comprises an amount of a carbonaceous material selected from raw coal, upgraded coal, petroleum coke and mixtures thereof.

* * * * *